US008960173B2

(12) United States Patent
Okupniak

(10) Patent No.: US 8,960,173 B2
(45) Date of Patent: Feb. 24, 2015

(54) COMPOUND BOW WITH RIGID DEFLECTING STOP

(76) Inventor: Christoph Okupniak, Aalen (DE)

( * ) Notice: Subject to any disclaimer, the term of this patent is extended or adjusted under 35 U.S.C. 154(b) by 0 days.

(21) Appl. No.: 13/371,574

(22) Filed: Feb. 13, 2012

(65) Prior Publication Data

US 2012/0204850 A1 Aug. 16, 2012

(30) Foreign Application Priority Data

Feb. 14, 2011 (DE) ..... 10 2011 004 036

(51) Int. Cl.
*F41B 5/10* (2006.01)
*F41B 5/14* (2006.01)

(52) U.S. Cl.
CPC ... *F41B 5/10* (2013.01); *F41B 5/14* (2013.01); *F41B 5/105* (2013.01); *Y10S 124/90* (2013.01)
USPC ..... 124/25.6; 124/23.1; 124/86; 124/900

(58) Field of Classification Search
CPC ..... F41B 5/10; F41B 5/14; F41B 5/105; Y10S 124/90
USPC ..... 124/23.1, 25.6, 86, 900
See application file for complete search history.

(56) References Cited

U.S. PATENT DOCUMENTS 1,526,176 A * 2/1925 O'Connell ..... 124/24.1
1,689,141 A * 10/1928 Keller ..... 124/22
2,186,386 A * 1/1940 Lowell ..... 124/24.1
2,909,167 A * 10/1959 Fredrickson ..... 124/25.7
3,945,368 A * 3/1976 Jones ..... 124/25.6
4,759,337 A * 7/1988 Suski ..... 124/24.1
5,649,519 A * 7/1997 Linderman ..... 124/23.1
5,934,265 A * 8/1999 Darlington ..... 124/25.6
6,082,346 A * 7/2000 Andrews et al. ..... 124/25.6
6,250,293 B1 * 6/2001 Andrews ..... 124/25.6
RE37,544 E * 2/2002 Darlington ..... 124/25.6
6,360,735 B1 * 3/2002 Larson et al. ..... 124/25.6
6,516,790 B1 * 2/2003 Darlington ..... 124/25.6
6,691,692 B1 * 2/2004 Adkins ..... 124/25.6
6,871,643 B2 * 3/2005 Cooper et al. ..... 124/25.6
6,990,970 B1 * 1/2006 Darlington ..... 124/25.6
6,994,079 B1 * 2/2006 Darlington ..... 124/25.6
7,066,165 B2 * 6/2006 Perry ..... 124/23.1
7,082,937 B1 * 8/2006 Land ..... 124/25.6
7,690,372 B2 * 4/2010 Cooper et al. ..... 124/25.6
7,770,568 B1 * 8/2010 Yehle ..... 124/25.6
8,006,679 B2 * 8/2011 Strother ..... 124/25.6
8,220,446 B2 * 7/2012 Batdorf ..... 124/25.6

(Continued)

FOREIGN PATENT DOCUMENTS

DE 102008063388 8/2010

*Primary Examiner* — Melba Bumgarner
*Assistant Examiner* — Alexander Niconovich
(74) *Attorney, Agent, or Firm* — Michael P. Kochka, Esq.

(57) ABSTRACT

Bow having a centerpiece, two flexurally elastic limbs, a string, at least one string pulley, mounted in one end of a limb and intended for accommodating the string, and at least two cable pulleys, connected rigidly to the string pulley and intended for accommodating and guiding compensating cables, and in each case at least one cable pulley is arranged on both sides of the string pulley, and the subassembly made up of the string pulley and cable pulleys is mounted in a rotatable manner in each case, and at least one deflecting stop is present for the purpose of limiting the deflection of the string, and this deflecting stop, when the string is deflected, strikes against a limb or against a stop element connected rigidly to the limb.

6 Claims, 6 Drawing Sheets

(56) References Cited

U.S. PATENT DOCUMENTS

| | | | | |
|---|---|---|---|---|
| 8,276,574 | B1 * | 10/2012 | Wilson | 124/25.6 |
| 8,281,774 | B2 * | 10/2012 | Grace | 124/25.6 |
| 8,360,041 | B2 * | 1/2013 | Strother | 124/25.6 |
| 8,469,013 | B1 * | 6/2013 | Obteshka et al. | 124/25.6 |
| 8,534,269 | B2 * | 9/2013 | Wilson et al. | 124/25.6 |
| 8,544,456 | B2 * | 10/2013 | Grace | 124/25.6 |
| 8,662,062 | B2 * | 3/2014 | Darlington | 124/25.6 |
| 2006/0174859 | A1 * | 8/2006 | Andrews | 124/25.6 |
| 2010/0132682 | A1 * | 6/2010 | Darlington | 124/25.6 |
| 2011/0146644 | A1 * | 6/2011 | Achkar | 124/25.6 |
| 2012/0000451 | A1 * | 1/2012 | Grace | 124/25.6 |

* cited by examiner

COMPOUND BOW WITH RIGID DEFLECTING STOP

This application claims the benefit of German Application No. DE 10 2011 004 036.6 filed Feb. 14, 2011 and entitled COMPOUND BOW WITH RIGID DEFLECTING STOP, which is hereby incorporated herein by reference in its entirety.

BACKGROUND

1. Field of the Invention

The invention relates to a bow, for example a sports or hunting bow or a crossbow.

2. Description of the Related Art

The principle common to the aforementioned pieces of sports or hunting equipment is that an archer draws a string by means of one or more elastic elements, so-called limbs, and then lets it go. The string here accelerates an arrow in the direction of a target. Modern bows or crossbows have little in common with the examples which are known from history. In particular, the variation in force when the string is drawn has, in the meantime, been adjusted optimally to the envisaged use. Therefore for example the force which has to be applied in order to draw a hunting bow in the first instance increases in relation to the deflection of the string and decreases again as the deflection of the string increases. In other words, in the first instance a comparatively large force is necessary in order to deflect the string even just by small amounts. As deflection increases, the force which acts on the archer's drawing arm decreases, and therefore a comparatively low level of force is required in order to hold the bow in its drawn position. This means that, for example in a hunting situation, the task of the archer aiming with the bow drawn is simplified to a considerable extent. This desired behaviour of the bow is achieved according to the prior art in that the string of the bow is guided on rotatable string pulleys at the ends of the limbs. Connected rigidly to the string pulleys, and thus likewise mounted in a rotatable manner, are the so-called cable pulleys, on which are guided compensating cables which serve for the symmetrical deformation of the limbs and for uniform force distribution. The geometry and method of mounting the string and cable pulleys here determine, in addition to other parameters, essentially the variation in force of the bow. The geometry of the string pulleys and of the cable pulleys can result, in particular, in the string no longer being subjected to any restoring force in the case of an excessively large amount of deflection, and therefore the drawn bow remains in its drawn state even in the cases where the archer lets go of the drawn string. This effect is also referred to by the term "cocking". Even just a slight action or movement can result in a sudden release of drawing tension from a bow drawn in such a way. Particularly in those cases where there is no arrow placed in position, which could convert the stored energy into kinetic energy, the above described sudden release of drawing tension from the bow may result in parts of the bow, in particular the string, the limbs or even the string or cable pulleys, being destroyed. Fragments flying around here may also be hazardous to, or injure, nearby individuals.

In the case of bows with compensating cables, it should be ensured that the arrow, during acceleration, does not come into contact with a compensating cable since, otherwise, the arrow could be deflected laterally or the compensating cable could also be damaged. In the case of a so-called shoot-through bow, this problem is solved in that the arrow, during shooting, is guided through between the compensating cables. The compensating cables are arranged symmetrically in relation to the plane of the string pulleys, wherein it is also possible, at the same time, to realize a high level of symmetry for the variation in force. It is thus also possible to prevent torsion of the bow as a whole as it is drawn. This is important because the elastic torsion of the bow could be released as the arrow accelerates and have an adverse effect on the following phase of flight of the arrow.

The following text will refer to a type 1 shoot-through bow, if the ends of the compensating cables are fitted on the limbs on one side, i.e. if the first end of a compensating cable runs on a cable pulley and the other end of the compensating cable is fixed on the limb opposite. This type of bow is also referred to, inter alia, as a twin-cam bow. In the case of a type 2 shoot-through bow, the compensating cables, in contrast, are not fastened on the limb; rather, they run over the cable pulleys on both sides of the bow. This is a special embodiment of the twin-cam bow, also known as a binary-cam bow.

For the purpose of avoiding cocking, German patent DE 10 2008 063 388 discloses the practice, for shoot-through bows, of having a deflecting stop strike against a compensating cable. The disadvantage here, however, is that the rotary position of the string pulley at maximum deflection, on account of the compliance of the compensating cable against which the deflecting stop strikes, is given only in the presence of comparatively high tolerance. There is no firmly defined stop, i.e. a precise rotary position of the string pulley in relation to the limb.

SUMMARY

It is an object of the invention to provide a type 1 or 2 shoot-through bow which has robust behaviour in relation to the outlined problem of "cocking" and in the case of which the maximum deflection of the string can be adjusted in a defined manner.

This object is achieved by the bow having the features given in Claim 1. The dependent claims relate to advantageous embodiments and developments of the invention.

The bow according to the invention has a centrepiece, two flexurally elastic limbs, a string and at least one string pulley, mounted in one end of a limb and intended for accommodating the string. The bow also contains at least two cable pulleys, connected to the string pulley and intended for accommodating and guiding compensating cables, wherein in each case at least one cable pulley is arranged on both sides of the string pulley, and wherein the subassembly made up of the string pulley and cable pulleys is mounted in a rotatable manner in each case, and at least one deflecting stop is present for the purpose of limiting the deflection of the string. The deflecting stop, when the string is deflected, strikes against a limb or against a stop element connected rigidly to the limb.

The advantages of the bow according to the invention are achieved by using rigid components which, in the case of an appropriate geometrical design and of an appropriate combination of components, result in adjustable and firmly defined limitation of the maximum deflection of the string.

The stop element may also be a spacer bolt connected rigidly to a limb.

The invention can be realized, in principle, using just one of the deflecting stops described. In addition, it is also conceivable to use a plurality of deflecting stops, in particular in each case one deflecting stop for the two limbs.

The deflecting stop here may be formed in one piece with the subassembly made up of the string pulley and cable pulleys or may be formed in one piece in a string pulley or a cable pulley. In addition, it is also conceivable to realize the deflecting stop as a component in more than one piece.

The deflecting stop described can advantageously be used in various compound bows or cam systems, for example binary, one and a half, solo-cam or two-cam systems and the different variants thereof.

When the string of the bow is drawn, it is possible for at least one compensating cable to run between that side of the deflecting stop on which the latter is connected to the subassembly made up of the string pulley and cable pulleys and that side of the deflecting stop which strikes against the limb or the stop element.

In other words, the deflecting stop may be configured such that it exhibits a recess into which the compensating cable can enter when the bow is drawn. The deflecting stop further exhibits an extension which, when the bow is drawn, moves past the compensating cable and strikes, by way of an end side, against a limb or a part connected rigidly to the limb. It is thus possible for the deflecting stop described to be configured, for example, in the form of a large L, wherein it has the short end of the L fastened on the subassembly made up of the string pulley and cable pulleys, and wherein the end of the long side of the L strikes against the limb or the component connected rigidly thereto. For adjustment capability of the deflecting stop, it is possible here to adjust, in particular, the length of the long side of the L. This is possible in a particularly straightforward manner, for example, in that the short side of the L has a threaded bore into which is screwed a screw—possibly secured by lock nuts—as the long side of the L. Straightforward rotation of the screw thus makes it possible to adjust the position of the deflecting stop.

Irrespective of the actual configuration of the deflecting stop, it is possible to vary the maximum deflection of the string by adjustment of the deflecting stop, in particular of the fastening position of the deflecting stop. The fastening position defines the position of the deflecting stop relative to the element on which the deflecting stop is fastened.

The maximum deflection of the string can be varied not just by the fastening position of the deflecting stop, but also by an alternative adjustment of the deflecting stop. It is thus conceivable, for example, to arrange the deflecting stop as a threaded screw in a corresponding threaded bore in the subassembly made up of the string and cable pulleys, and therefore the length of the deflecting stop can be adjusted by straightforward rotation in the thread.

As an alternative, or in addition, the maximum deflection of the string can also be varied by adjustment of the stop element.

The bow may be a twin-cam bow, i.e. a type 1 bow.

The bow may also be a binary-cam bow, i.e. a type 2 bow.

In an advantageous embodiment of the invention, the bow is a shoot-through bow with shoot-through centrepiece.

A shoot-through centrepiece is a centrepiece in the case of which the arrow, rather than being moved past the centrepiece, can be guided through an opening provided in the centrepiece itself. This gives a greater range of possibilities for configuring the centrepiece.

Since the shoot-through centrepiece is formed symmetrically in relation to a plane which is formed by the string when the bow is drawn, it is possible for the bow according to the invention to be further optimized in respect of its behaviour during shooting. The improved dynamic behaviour of the bow here can be attributed in particular to the fact that the aforementioned symmetrical configuration of the shoot-through centrepiece means that the bow is, in practice, of fully symmetrical construction. As a result, torques to which the bow could be subjected as a result of forces of inertia in particular from the limbs and the centrepiece are reduced to a considerable extent, and shooting is more stable overall. Lateral deformation of the shoot-through centrepiece under the action of the forces emanating from the drawn limbs can also be effectively reduced in this way.

The above described shoot-through centrepiece can be used in various compound bows or cam systems, for example binary, one and a half, solo-cam or two-cam systems, and the different variants thereof, with or without the deflecting stop described above.

Furthermore, it is also possible to implement additional components on the shoot-through bow. For example, additional elements can be used to position the compensating cables such that the arrow can be shot through between the compensating cables without obstruction. This is also possible, inter alia, using a cable spreader, of which the U-shaped construction gives rise to an increased spacing between the compensating cables. Furthermore, it is also possible to fit one or more string stoppers, which are in contact with the string in the undrawn state and, when the string is released, can also be used to reduce vibration. It is also possible to implement so-called reverse roller guards or reverse assist roller guards, which guide the compensating cables in a fixed position over rollers. The string stoppers and the reverse roller guards may also be realized by a composite component, wherein this may be in one or more parts, and/or may also be adjustable.

BRIEF DESCRIPTION OF THE DRAWINGS

An exemplary embodiment of the invention will be explained in more detail hereinbelow with reference to the drawing, in which.

DETAILED DESCRIPTION

Figure 1:
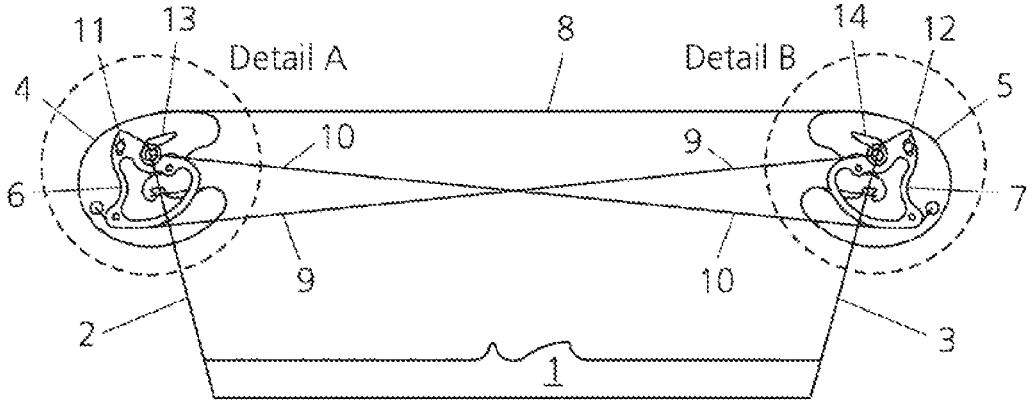
FIG. 1 shows a side view of a schematic illustration of a type 1 shoot-through bow in the undrawn state.

FIG. 1 shows a schematic illustration of an exemplary embodiment of an undrawn type 1 bow according to the invention having the centrepiece 1 followed by the two limbs 2 and 3. The string pulleys 4 and 5 are arranged in a rotatable manner at each of the ends of the limbs 2 and 3. In each case two cable pulleys are connected rigidly to the string pulleys 4 and 5, wherein the cable pulleys which can be seen in FIG. 1 are designated by 6 and 7. The string 8 here runs in a first groove on the string pulleys 4 and 5, whereas the compensating cables 9 and 10 run in a second groove and third groove, respectively, on the cable pulleys 6 and 7. In addition, in each case one deflecting stop 11 and 12 is mounted on the rigidly interconnected string and cable pulleys 6 and 7. The deflecting stop 11 or 12 here serves to limit the drawing movement of the bow. The stop elements 13 and 14 may also be fitted on the limbs (cf. FIG. 7).

Figure 2:
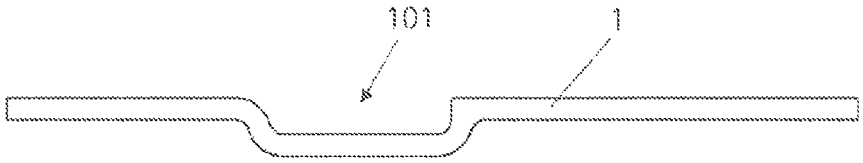
FIG. 2 shows a straightforward embodiment of a centrepiece of a shoot-through bow.

FIG. 2 contains a centrepiece 1 of a shoot-through bow embodied with an aperture 101 on one side. When the arrow is shot, the arrow is moved past the centrepiece 1 in the region of the aperture 101, and its trajectory is not obstructed here.

Figure 3:
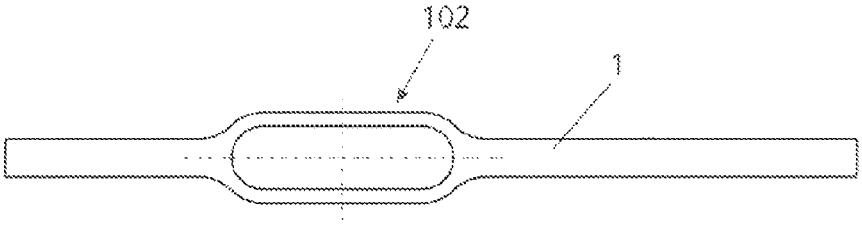
FIG. 3 shows a plan view of a centrepiece of a shoot-through bow embodied as a shoot-through centrepiece.

FIG. 3 illustrates a centrepiece 1 of a shoot-through bow in the form of a shoot-through centrepiece. The arrow, during shooting, is moved through the mirror-symmetrical aperture 102 of the shoot-through centrepiece. In particular the symmetrical aperture 102 of the shoot-through centrepiece results in the avoidance of torsion of the bow as it is drawn.

Figure 4:
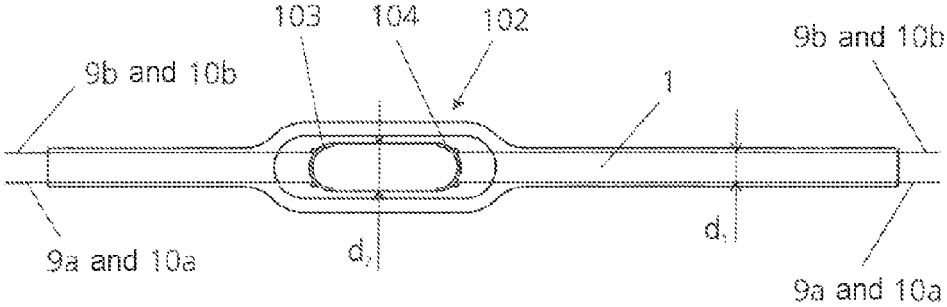
FIG. 4 shows the shoot-through centrepiece from FIG. 3 with four compensating cables and two cable spreaders.

FIG. 4 shows the centrepiece 1 from FIG. 3, the four compensating cables 9*a*, 9*b* and 10*a*, 10*b* also being depicted. FIG. 4 also contains two cable spreaders 103 and 104, which move the compensating cables 9*a*, 9*b* and 10*a*, 10*b* from the spacing $d_1$ to the spacing $d_2$ in the region of the symmetrical aperture 102. This makes it possible for the arrow, during shooting, also to be guided past the compensating cables 9*a*, 9*b* and 10*a*, 10*b*.

Figure 5:
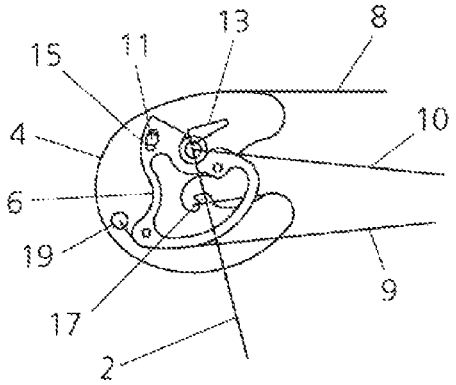
FIG. 5 shows a detail-form view of the left-hand string and cable pulleys of the shoot-through bow from FIG. 1.

FIG. 5 contains the detail A from FIG. 1, the left-hand string and cable pulleys 4 and 6 of the shoot-through bow being illustrated. FIG. 5 also shows, inter alia, the fastening of one end of the compensating cable 10 on the limb 2. It is also possible for the stop elements 13 and 14 to be fitted on the limbs (cf. FIG. 7). It can also be seen that the deflecting stop 11 is positioned in a slot 15 and can be fastened in a position which can be freely selected within the slot 15. It is thus possible to change the maximum deflection comparatively quickly within a certain framework. The string 8 runs part of the way around the string pulley 4 and, as illustrated here, can have its end fastened on a hook 17, which is integrated in the string pulley 4. The compensating cable 9 can also be guided, for example, through the string pulley 4, via the bore 19, and thus fastened.

Figure 6:
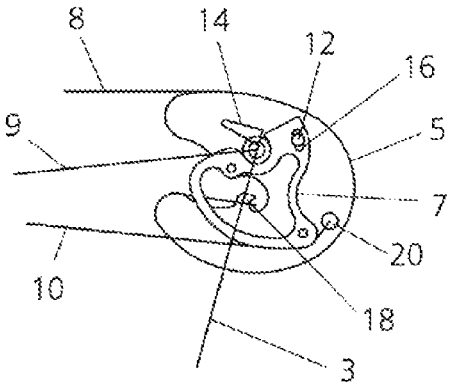
FIG. 6 shows a detail-form view of the right-hand string and cable pulleys of the shoot-through bow from FIG. 1.

FIG. 6 illustrates the detail B from FIG. 1, the string and cable pulleys 5 and 7 on the right-hand side of the shoot-through bow being shown here. In a manner corresponding to FIG. 5, the deflecting stop 12 here can be positioned, and fastened, in the slot 16. The end of the compensating cable 9 is fastened on the limb 3. On this side, too, the string 8 encircles part of the string pulley 5. In the exemplary embodiment shown, the end of the string 8 is fastened on the hook 18. The limb 3 may also have the stop element 14. In the exemplary embodiment shown, the compensating cable 10 is fitted on the protuberance 20 on the string pulley 7.

Figure 7:
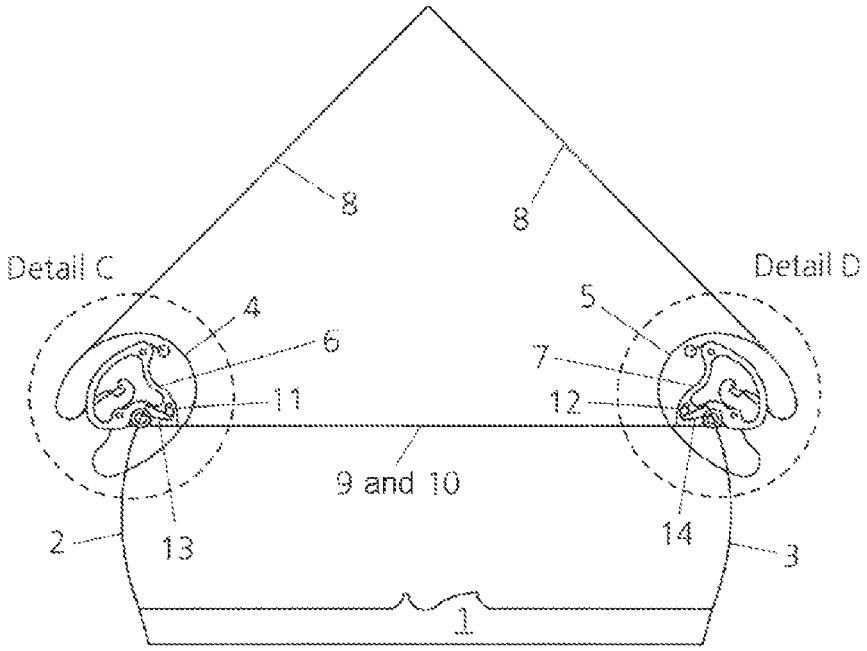
FIG. 7 shows the shoot-through bow from FIG. 1, likewise in a side view, in the fully drawn state.

FIG. 7 shows the type 1 shoot-through bow in the fully drawn state. For drawing purposes, the archer draws the string 8 usually with one hand, while he uses the other hand to hold the centrepiece 1. As the bow is drawn, the string pulleys 4 and 5 move together with the cable pulleys 6 and 7, a desired variation in force and displacement taking place. In the illustration shown, the deflecting stops 11 and 12 are in contact with the stop elements 13 and 14 fitted on the two limbs 2 and 3, and this therefore prevents the shoot-through bow from being drawn further.

Figure 8:
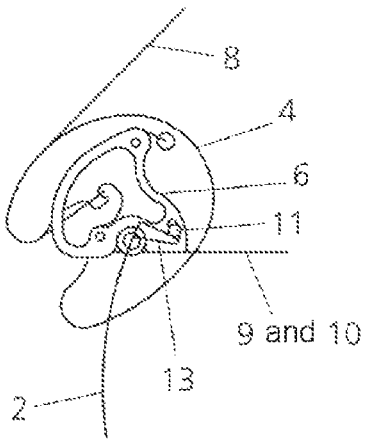
FIG. 8 shows a detail-form view of the left-hand string and cable pulleys of the shoot-through bow from FIG. 7.
Figure 9:
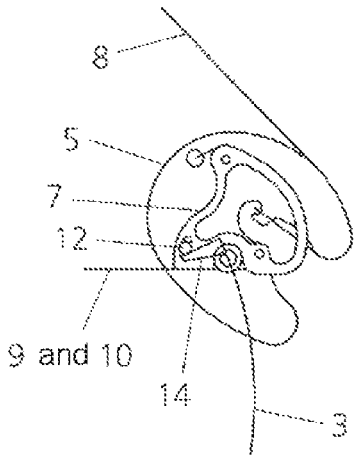
FIG. 9 shows a detail-form view of the right-hand string and cable pulleys of the shoot-through bow from FIG. 7.

FIG. 8 contains the detail C from FIG. 7, while FIG. 9 shows the detail D from FIG. 7. It can be seen in FIGS. 8 and 9 that, in this case, the compensating cables 9 and 10, when the bow is fully drawn, are located approximately one above the other. The deflecting stops 11 and 12 butt against the two stop elements 13 and 14 of the limbs 2 and 3. However, it is also possible to have an arrangement in which the deflecting stops 11 and 12 strike directly against the limbs 2 and 3.

Figure 10:
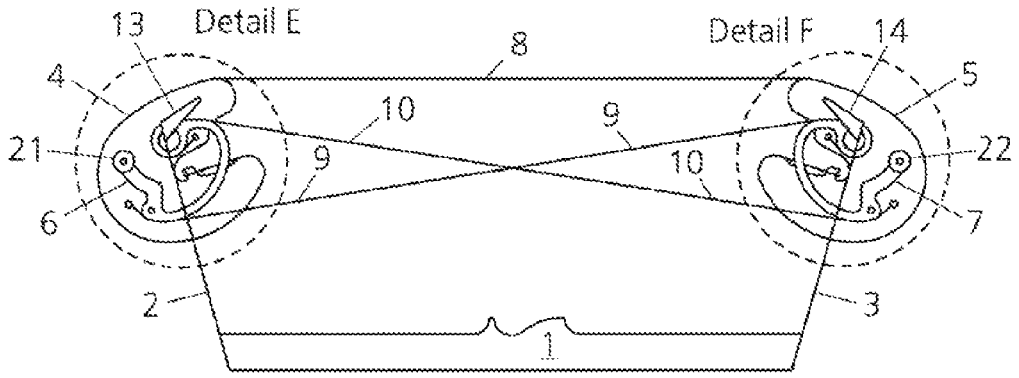
FIG. 10 shows a side view of a type 2 shoot-through bow in the undrawn state.

FIG. 10 shows a type 2 shoot-through bow. The limbs 2 and 3, the string pulleys 4 and 5 and the cable pulleys 6 and 7 are arranged in a manner comparable to that for the type 1 shoot-through bow. In this case, however, the compensating cables 9 and 10, rather than being connected to the limbs 2 and 3, run on the grooves of the cable pulleys 6 and 7. The deflecting stops on each side may be formed here by two rollers 21 and 22, which are mounted, for example in a rotatable manner. Further alternative embodiments, however, are also possible for the deflecting stops, wherein it is necessary in each case for it to be possible for the deflecting stops to strike against the limbs of the shoot-through bow or against components such as, for example, the stop elements (illustrated here) fitted on the limbs.

Figure 11:
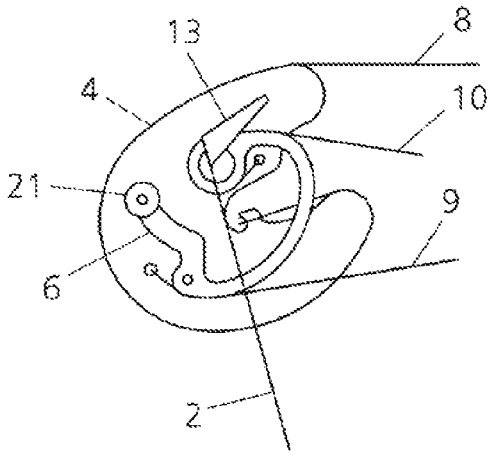
FIG. 11 shows a detail-form view of the left-hand string and cable pulleys of the shoot-through bow from FIG. 10.
Figure 12:
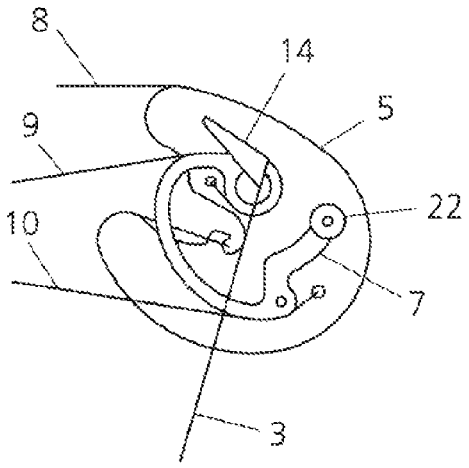
FIG. 12 shows a detail-form view of the right-hand string and cable pulleys of the shoot-through bow from FIG. 10.

FIG. 11 contains the detail E from FIG. 10, i.e. the left-hand string and cable pulleys 4 and 6 of the type 2 shoot-through bow, while FIG. 12 shows, as detail F, the right-hand string and cable pulleys 5 and 7 of the shoot-through bow from FIG. 10.

Figure 13:
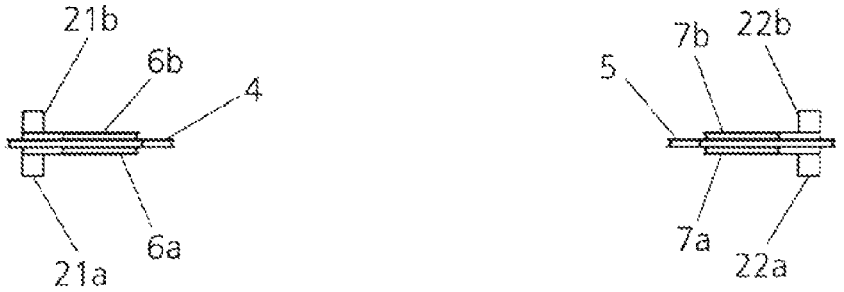
FIG. 13 shows a plan view of the shoot-through bow from FIG. 10.

The illustration in FIG. 13 shows a plan view of the shoot-through bow, wherein the string pulleys 4 and 5, the cable pulleys 6*a*, 6*b* and 7*a*, 7*b* and the deflecting stops 21*a*, 21*b* and 22*a*, 22*b* are illustrated. It is possible to see here the symmetrical construction of these components in relation to the string of the shoot-through bow, this string not being illustrated here.

Figure 14:
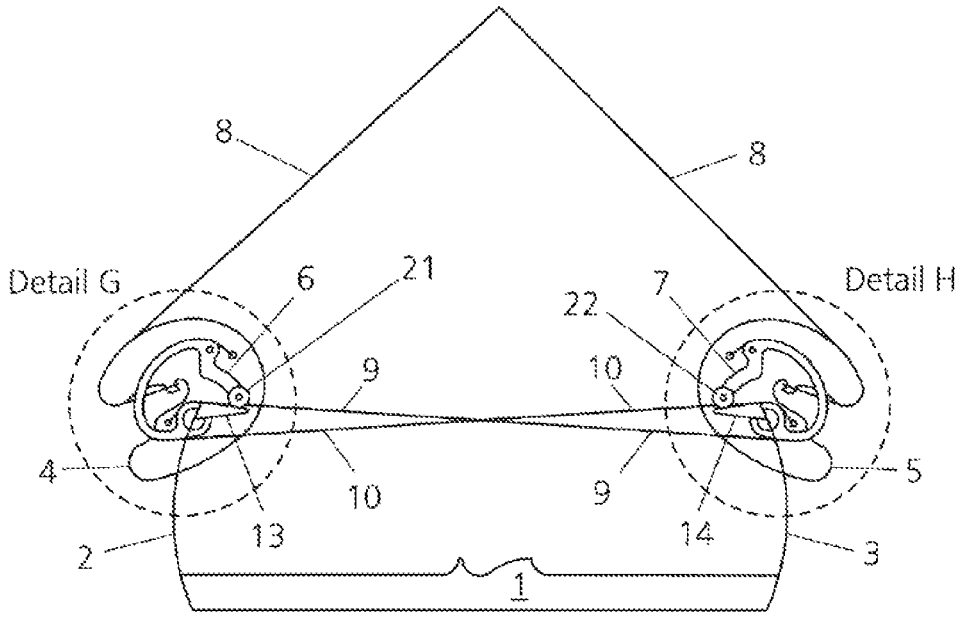
FIG. 14 shows a side view of the shoot-through bow from FIG. 10 in the fully drawn state.

FIG. 14 shows the type 2 shoot-through bow from FIG. 10 in the fully drawn state. The rollers 21 and 22 of the deflecting stops are in contact here with the stop elements 13 and 14 of the two limbs 2 and 3. Should these rollers 21 and 22 be absent, then it is provided, for safety purposes and in order to avoid "cocking", that, as the bow is drawn, the cable pulleys 6 and 7 push against the compensating cables 9 and 10, respectively. This means that the shoot-through bow cannot be deflected any further.

Figure 15:
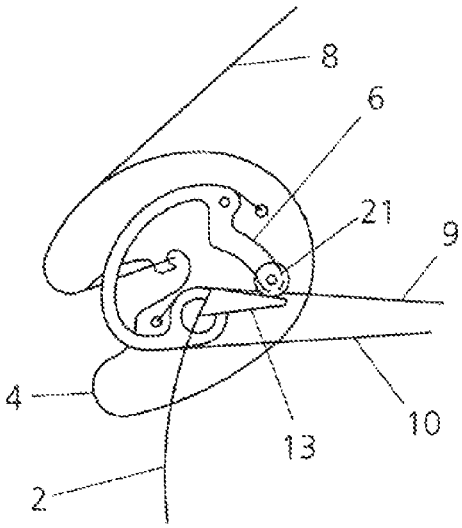
FIG. 15 shows a detail-form view of the left-hand string and cable pulleys of the shoot-through bow from FIG. 14.
Figure 16:
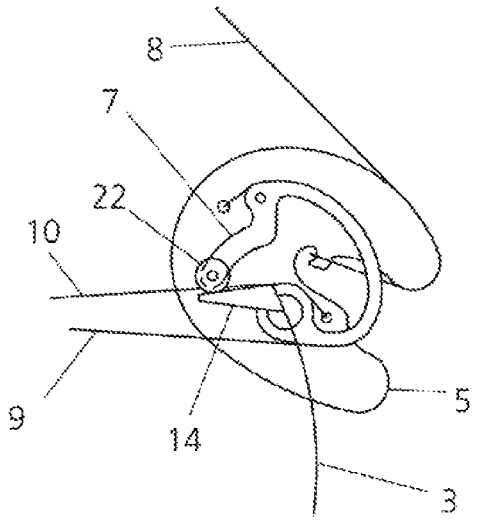
FIG. 16 shows a detail-form view of the right-hand string and cable pulleys of the shoot-through bow from FIG. 14.

FIG. 15 contains a detail-form view of the left-hand string and cable pulleys of the shoot-through bow from FIG. 14, while FIG. 16 shows a detail-form view of the right-hand string and cable pulleys of the shoot-through bow from FIG. 14. It can clearly be seen here that the cable pulleys 6 and 7, in the drawn state of the shoot-through bow, can strike, for safety purposes, against the compensating cables 9 and 10, should the rollers 21 and 22 of the deflecting stop be absent.

The inventive concepts described can also be used analogously for all compound bows in which the compensating cables, as a result of additional guide elements, are deflected asymmetrically, in relation to a plane formed by the string and the centrepiece of the bow, onto one side of the bow, and the arrow can thus be moved past the compensating cables during shooting, and for a crossbow or the like. It is thus intended for the term "bow" used in the present application also to cover the configuration of the apparatus according to the invention as a crossbow or a plaything, or a piece of sports and/or hunting equipment, which accelerates arrows, balls, bolts or the like.

The invention claimed is:

1. A bow having a centrepiece, comprising:

two flexurally elastic limbs;

a string;

at least one string pulley mounted in one end of one of the two flexurally elastic limbs and intended for accommodating the string;

at least two cable pulleys connected to the string pulley, the at least two cable pulleys adapted to accommodate and guide compensating cables;

the at least two cable pulleys arranged on both sides of the string pulley;

a subassembly mounted in a rotatable manner, the subassembly comprising the string pulley and cable pulleys; and at least one deflecting stop connected to the subassembly adapted to limit the deflection of the string, the deflecting stop adapted to strike against a stop element connected rigidly to the limb when the string is deflected, the deflecting stop being sufficiently rigid to stop further deflection of the string when the deflecting stop strikes against the stop element, whereby the deflecting stop is prevented from hitting the compensating cables when the bow is drawn.

2. The bow as set fort in claim 1, wherein when the bow is drawn, at least one compensating cable runs between a portion of the deflecting stop that is connected to the subassembly and a portion of the deflecting stop that contacts the stop element.

3. The bow as set forth in claim 1, wherein the maximum deflection of the string can be varied by adjustment of the deflecting stop.

4. The bow as set forth in claim 1, wherein the bow is a binary-cam bow.

5. The bow as set forth in claim 4, wherein it is a shoot-through bow with shoot-through centrepiece.

6. The bow according to claim 5, wherein the shoot-through centrepiece is formed symmetrically in relation to a plane which is formed by the string when the bow is drawn.

* * * * *